United States Patent [19]

Schlientz

[11] Patent Number: 4,721,299

[45] Date of Patent: Jan. 26, 1988

[54] STRUCTURE ASSEMBLED FROM STRUCTURAL MEMBERS

[75] Inventor: Rainer W. Schlientz, Zurich, Switzerland

[73] Assignee: Ludopark AG., Zug, Switzerland

[21] Appl. No.: 689,860

[22] Filed: Jan. 8, 1985

[30] Foreign Application Priority Data

Jan. 11, 1984 [CH] Switzerland ..... 129/84

[51] Int. Cl.[4] ..... A63B 9/00; A63B 17/00

[52] U.S. Cl. ..... 272/113; 52/309.9; 52/646; 285/138; 285/390; 446/124; 138/149

[58] Field of Search ..... 52/309.9, 309.13, 576, 52/577, 646; 138/175, 149; 446/117, 124, 120, 128; 285/390, 391, 393, 149, 138, 47, 41; 272/113

[56] References Cited

U.S. PATENT DOCUMENTS

| | | | |
|---|---|---|---|
| 1,218,895 | 3/1917 | Porter | 285/138 |
| 1,267,835 | 5/1918 | Zwicker | 138/175 |
| 1,441,908 | 1/1923 | Billie | 138/175 |
| 1,731,171 | 10/1929 | Miller | 285/390 |
| 2,133,376 | 10/1938 | Brown | 138/149 X |
| 3,013,584 | 12/1961 | Reed | 52/727 |
| 3,295,281 | 1/1967 | Dixon | 52/585 |
| 3,593,480 | 7/1969 | Bouchillion | 52/309.17 |
| 3,813,115 | 5/1974 | French | 285/391 |
| 3,878,661 | 4/1975 | Moore | 52/577 |
| 3,895,796 | 7/1975 | Pestalozzi . | |
| 4,025,091 | 5/1977 | Zeile | 138/149 |
| 4,273,161 | 6/1981 | McLaughlin | 138/149 |
| 4,428,591 | 1/1984 | Marissen | 285/138 |
| 4,462,618 | 7/1984 | Stone | 138/149 |
| 4,475,749 | 10/1984 | Pforr | 138/149 |
| 4,478,253 | 10/1984 | Everett | 138/149 |
| 4,560,012 | 12/1985 | McNeely | 138/149 |

*Primary Examiner*—John E. Murtagh
*Attorney, Agent, or Firm*—Bachman & LaPointe

[57] ABSTRACT

The structural member, such as a pipe has a pipe wall, whose inner and outer surfaces are formed by plastic surface layers. Between the surface layers is provided a space, which is filled with a material differing from that of the surface layers. If the structural member is used as a foundation part of a structure, the space is filled with a material or a non-porous plastic for increasing the strength and stability of the pipe, while for other, that is overlying structural members, the space is filled with a lower density material, such as PUR (Polyurethane) foam, or is in the form of a cavity. Thus, the foundation parts are not subject to unnecessarily high loading and material is saved. Playing and gymnastic structures with a random spatial arrangement can be formed from the structural members.

6 Claims, 11 Drawing Figures

FIG. 1
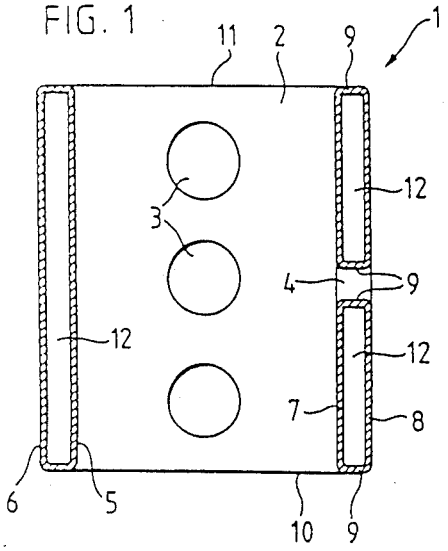
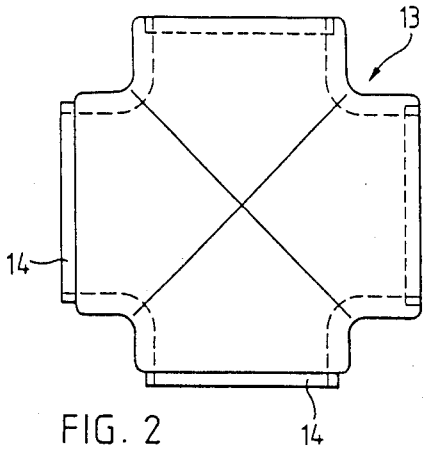
FIG. 2
FIG. 3
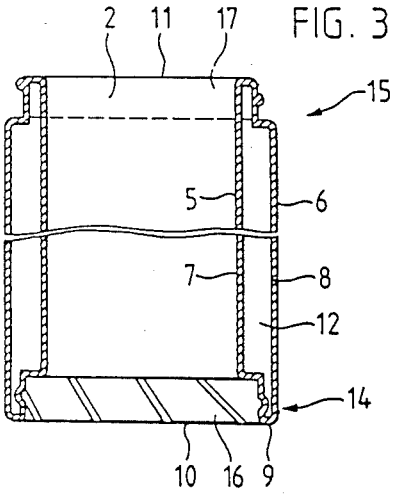
FIG. 4
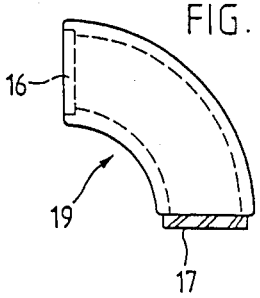
FIG. 5
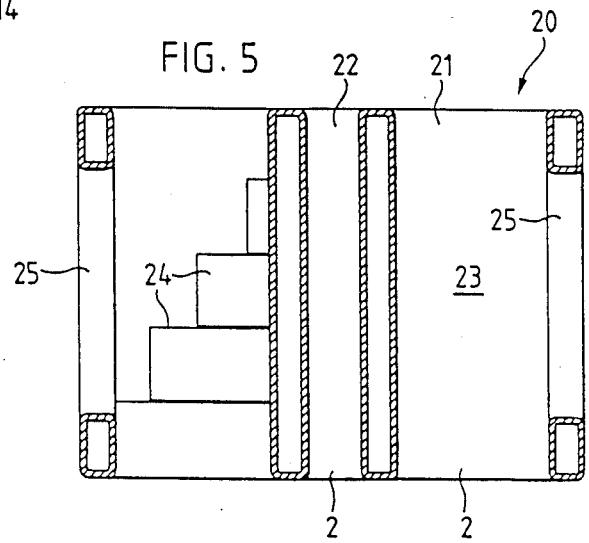
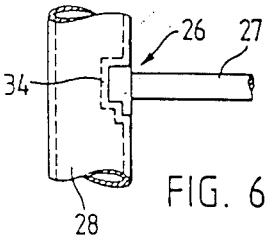
FIG. 6

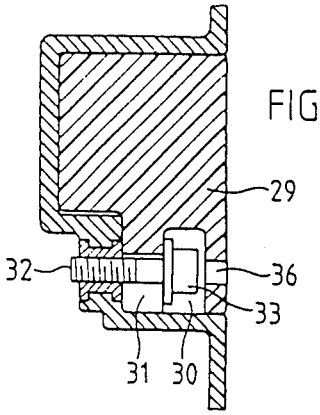
FIG. 7
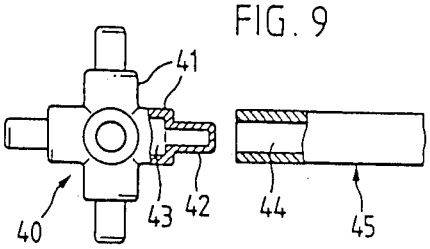
FIG. 9
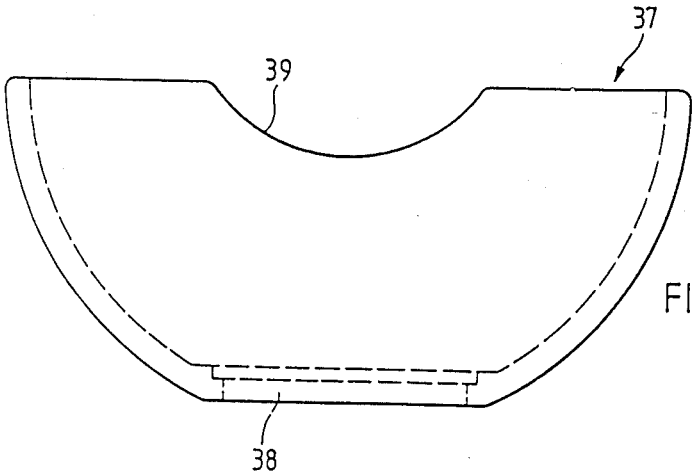
FIG. 8
FIG. 10
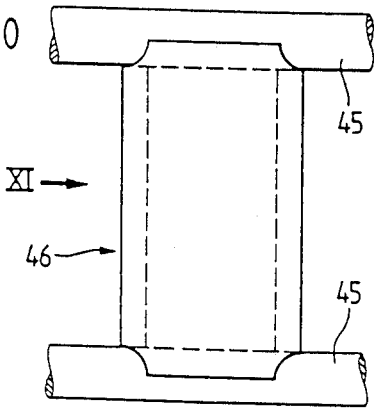
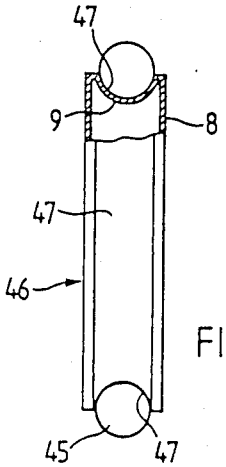
FIG. 11

STRUCTURE ASSEMBLED FROM STRUCTURAL MEMBERS

BACKGROUND OF THE INVENTION

The present invention relates to a structure assembled from a plurality of structural members in a random spatial arrangement.

Numerous different constructions are known of structures, particularly in the form of playing and/or gymnastic structures for children in playgrounds. In one known construction (U.S. Pat. No. 3,895,796) the structure comprises pipe sections which, as an entity, form a pipe through which it is possible to walk or crawl, whose straight and curved pipe sections pass in sharp turns above and below one another and thereby form a maze-like structure, the telescoped pipe sections being held together with additional connecting elements, such as clips and collars.

In another known embodiment (U.S. Pat. No. 3,485,494) the structure comprises circular cylindrical and parallelepipedic pipe sections forming a labyrinth in which it is possible to walk following assembly.

Other known constructions are formed from parts having a specific shape, such as bars (U.S. Pat. No. 3,969,871), parallelepiped blocks (U.S. Pat. No. 3,561,557) polyhedrons (U.S. Pat. No. 3,949,985), etc.

In all these known constructions, the structural members are made from different types of plastic. If they are used as foundation parts for a structure which, apart from the weight of the superstructures also have to carry the weight of the persons on the same, they must have an adequate strength and stability. Since for reasons of easier manufacture, these parts are always made with the same dimensions, the parts used only as superstructures are overdimensioned and consequently place an additional load on the foundation parts.

SUMMARY OF THE INVENTION

The problem of the present invention is to so construct a structure of the aforementioned type, that the aforementioned disadvantages are avoided. The structural members used in such a structure as foundation parts will have an adequate strength and stability but, when used as superstructures, will not place an additional weight on the foundation. In addition, the structural members have no shapes with sharp edges and where such shapes are unavoidable, e.g. at fixed connections between bars or ladder rungs and the structural members, they are covered by filling bodies.

According to the invention, this problem is solved by a structure of the aforementioned type, wherein at least part of the structural members are hollow bodies, whose contours are formed by walls, whose lateral surfaces comprise surface layers, between which a space is formed, which is filled with a material differing from the material of the surface layers.

BRIEF DESCRIPTION OF THE DRAWINGS

The invention is described in greater detail hereinafter relative to non-limitative embodiments and the attached drawings, wherein show:

FIG. 1 is a longitudinal section through a structure constructed as a straight pipe section.

FIG. 2 is a side view of a cross for pipes.

FIG. 3 is a longitudinal section through a straight pipe section similar to FIG. 1 with threaded sockets on the end faces.

FIG. 4 is a side view of a bend.

FIG. 5 is a longitudinal section through a circular cylindrical structural member with a spiral staircase incorporated therein.

FIG. 6 is a side view of a connecting point in a structural member for fixing a bar.

FIG. 7 is a longitudinal section through a filling body as a cover for a connecting point according to FIG. 6.

FIG. 8 is a side view of a structural member constructed as a half-shell.

FIG. 9 is a side view, partly in section, of a cross with arms for connecting structural members.

FIG. 10 is a side view of a wall member for fixing to structural members.

FIG. 11 is a view, partly in section of the wall member according to FIG. 10 from direction XI.

DETAILED DESCRIPTION

The invention is based on the basic consideration that in structural members which are mainly used in the construction of playing and gymnastic structures for children, it is necessary to avoid edges and corners which are liable to cause accidents. Therefore, the structural members provided for the structure according to the present invention are in the form of hollow bodies having convexities, while the openings preferably have a circular surface shape.

FIG. 1 shows a straight pipe 1, whose wall 2 has a number of openings 3, 4 of different sizes. The arrangement and number of the openings 3, 4 can be selected at random and are used on the one hand as openings for the entry of light and on the other hand as fixing openings for further structural members to be connected to pipe 1.

The lateral surface of wall 2, that is inner surface 5 and outer surface 6 are formed by surface layers 7, 8, which through connecting layers 9 are located on the end faces 10, 11 of pipe 1 and on openings 3, 4. A closed cavity 12 is formed in pipe wall 2 through the surface layers 7, 8 and the connecting layers 9. The cavity 12 can be filled with various materials. If the pipe 1 is used as a structural member in the foundation part of a structure, the cavity 12 can be filled with a filler, which increases the stability and strength of the pipe. A non-porous plastic or a denser material, e.g. water, a ceramic material such as cement, mortar, concrete, sand, gravel, etc. is suitable for this purpose. However, if pipe 1 is used as a superstructure, it is appropriate to fill cavity 12 with a lighter material, for which purpose is suitable a plastic foam, such as a PUR (polyurethane) foam. A plastic, such as polyethylene, polypropylene or PVC (polyvinylchloride) is suitable as the material for working the surface layers 7, 8 and the connecting layers 9.

FIG. 2 shows a cross 13, which is constructed as a hollow body with four openings, on whose end face is provided a connecting edge 14, which is used for assembling cross 13 with other structural members.

FIG. 3 shows another pipe, which has a similar construction to that of FIG. 1. It also has surface layers 7, 8, which form the inner surface 5 and outer surface 6 of wall 2. A cavity 12 is once again provided between the surface layers 7, 8 and which, as in the case of pipe 1, can be filled when required. However, it is also possible to use both pipe 1 and pipe 15 with an empty cavity, that is filled only with compressed air.

In the case of pipe 15, the connecting edge 14 can be constructed as a threaded socket. In this case, appropriately the threaded socket 16 on end face 10 has an internal thread and threaded socket 17 on the opposite end face 11 an external thread. If all the structural members are provided with threaded sockets 16, 17 they can be positively interconnected. However, since instead of threaded connections, the structural members can at least partly also be provided with smooth pipe sockets on the free edges to enable them to be assembled, account can be taken of the thermal expansion occurring with plastic parts.

In the same way as pipe 15, the bend 19 in FIG. 4 is provided with threaded sockets 16, 17.

The structural member 20 according to FIG. 5 has a hollow cylinder 21 and a central cylinder 22 arranged therein. The walls 2 of the two cylinders 21, 22 are constructed in the same way as structural members 1 and 15 according to FIGS. 1 and 3. The two cylinders 21, 22 define an annular space 23, in which there are stairs 24. Large openings 25 in the wall 2 of hollow cylinder 21 permit entry to the staircase formed by stairs 24. If a plurality of structural members 20 are placed on top of one another, it is possible to construct a spiral staircase with a random number of stairs. The structural members can be twisted against one another, so that a shoulder is formed between each structural member, which reduces accident risks.

FIG. 6 shows a connecting point 26, where a bar 27 is fixed to a structural member 28, such as a pipe. Such connecting points 26 are required in the case of gymnastic equipment and in the case of ladders for fixing the rungs. To enable the structural member 28 to be used for other purposes, it is necessary to fill the connecting point 26 with a filling body 29, see FIG. 7, in order to reduce the accident risk. The filling body 29 is fixed in the same way as bar 27. For this purpose, filling body 29 is provided with a recess 30 and a web 31, which is slotted to such an extent that the shank 32 of a connecting screw 33 can be pressed through the slot into the position shown in FIG. 7. The filling body 29 can then be inserted in the fixing depression 34 in structural member 28 and the screw 33 can be screwed into a thread insert anchored in structural member 28. For this purpose, filling body 29 has an opening 36 for inserting a spanner, such as a hexagon spanner, for tightening screw 33.

FIG. 8 shows a further structural member in the form of a half-shell 37, which has an opening 38 which can be used as a passage or fixing opening for a further structural member. A recess 39 can also be used for mounting further structural members.

The described structural members can be combined in numerous different ways. If necessary, they can be supplemented by further structural members, such as by angle pieces and pipe angles with angles differing from a right angle, whose walls are constructed in the same way as the walls of the structural members. Obviously, the structural members can also be used with other elements, like bars 27 according to FIG. 6. Thus, FIG. 9 shows a cross 40, which comprises a plurality of radially extending arms 31, which can be arranged both in the plane and in the space. Onto the ends of arms 41 are shaped pins 42, see FIG. 9, which can be inserted in a hole 44 in structural member 45. Thus, not only structural member 45, but also other structural members can be interconnected. Cross 40 has a cavity 43 which, as required, can be filled with material or left empty as described hereinbefore.

FIGS. 10 and 11 show that the structural members can be constructed not only as cylindrical or spherical hollow bodies or shells, but also in the form of a plate 46. Plate 46 can be constructed in the same way as the aforementioned structural members, that is as a hollow body with surface layers 8, 9. The plate has channel-like depressions 47 along its edges. By means of said depressions 47, the plates 46 can be assembled in a simple manner with other structural members, such as rods or pipes, as is shown in FIGS. 10 and 11.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A gymnastic or playground structure assembled from a plurality of structural members in random spatial arrangement wherein at least one of the structural members comprises a hollow body having sidewalls defining the contour of said hollow body, said sidewalls comprising two substantially parallel lateral wall portions defining a space therebetween and end wall portions unitarily connecting said lateral wall portions so as to define a closed space wherein said sidewalls are provided with at least one opening penetrating said sidewalls for allowing access to the interior of said hollow body, said lateral wall portions and said end wall portions of said structural members are made from plastic and the closed space formed between said lateral wall portions and said end wall portions is filled with a material whose density differs from that of the material of said lateral wall portions and said end wall portions and said sidewalls are provided with connecting means for coupling said structural members together in the area of said end wall portions, said connecting means comprises an internal threaded socket on one of said end wall portions and an external threaded socket on the other of said end wall portions such that the internal socket of one structural member is connected to the external socket of the other structural member.

2. A structure according to claim 1, wherein the material of the closed space is a plastic.

3. A structure according to claim 1 wherein the material of the closed space is a denser material than that of said lateral wall portions and said end wall portions.

4. A structure according to claim 1 wherein the structural members are pipe sections.

5. A structure according to claim 1 wherein the structural members have connecting points with a fixing depression, said depression being filled by a filling body and the outside thereof forms a smooth wall with an opening enabling the filling body to be screwed to the structural member.

6. A structure according to claim 1 wherein the structural members are hollow bodies in the form of plates, which are provided with circular cylindrical depressions running along their edges.

* * * * *